US008881456B2

(12) United States Patent
Xu

(10) Patent No.: US 8,881,456 B2
(45) Date of Patent: Nov. 11, 2014

(54) SHADING DEVICES

(76) Inventor: Peng Xu, Moraga, CA (US)

( * ) Notice: Subject to any disclaimer, the term of this patent is extended or adjusted under 35 U.S.C. 154(b) by 167 days.

(21) Appl. No.: 13/406,493

(22) Filed: Feb. 27, 2012

(65) Prior Publication Data

US 2012/0216964 A1 Aug. 30, 2012

Related U.S. Application Data

(60) Provisional application No. 61/447,050, filed on Feb. 27, 2011, provisional application No. 61/447,051, filed on Feb. 27, 2011.

(51) Int. Cl.
*E06B 7/08* (2006.01)

(52) U.S. Cl.
USPC ..... 49/64; 49/92.1; 49/74.1

(58) Field of Classification Search
USPC ..... 49/74.1, 92.1, 61, 62, 63, 64, 65, 67; 359/596, 594
See application file for complete search history.

(56) References Cited

U.S. PATENT DOCUMENTS

| | | | | | |
|---|---|---|---|---|---|
| 2,239,528 | A | * | 4/1941 | Knudsen | 49/64 |
| 2,281,071 | A | * | 4/1942 | Knudsen | 49/64 |
| 2,486,000 | A | * | 10/1949 | Browning | 160/176.1 R |
| 2,490,295 | A | * | 12/1949 | Fisher | 49/64 |
| 2,545,906 | A | * | 3/1951 | Watkins | 359/596 |
| 2,651,085 | A | * | 9/1953 | Kopp | 49/64 |
| 2,854,102 | A | * | 9/1958 | Peeples | 49/82.1 |
| 2,889,591 | A | * | 6/1959 | Pratt | 49/390 |
| 3,022,549 | A | * | 2/1962 | Cummings | 49/64 |
| 3,153,819 | A | * | 10/1964 | Bond | 49/64 |
| 3,201,832 | A | * | 8/1965 | Hordis et al. | 49/64 |
| 3,291,193 | A | * | 12/1966 | Hagerty et al. | 160/107 |
| 3,318,360 | A | * | 5/1967 | Persson | 160/107 |
| 3,702,040 | A | * | 11/1972 | Roy | 49/64 |
| 3,719,221 | A | * | 3/1973 | Hanson | 60/168.1 R |
| 3,795,267 | A | * | 3/1974 | Debs | 160/168.1 R |
| 4,040,725 | A | * | 8/1977 | Goodbar | 359/596 |
| 4,128,307 | A | * | 12/1978 | Badertscher et al. | 359/596 |
| 4,292,763 | A | * | 10/1981 | Barnes et al. | 49/64 |
| 4,306,387 | A | * | 12/1981 | Hopkins et al. | 52/1 |
| 4,355,676 | A | * | 10/1982 | Lee | 160/107 |
| 4,443,978 | A | * | 4/1984 | Butler | 52/1 |
| 4,452,010 | A | * | 6/1984 | Whittington et al. | 49/51 |
| 4,459,778 | A | * | 7/1984 | Ball | 49/64 |
| 4,505,069 | A | * | 3/1985 | Freeman | 49/64 |
| 4,586,289 | A | * | 5/1986 | Jaeger | 49/64 |

(Continued)

FOREIGN PATENT DOCUMENTS

| | | | |
|---|---|---|---|
| CN | 2775270 | Y | 4/2006 |
| CN | 1908358 | A | 2/2007 |

(Continued)

*Primary Examiner* — Jerry Redman
(74) *Attorney, Agent, or Firm* — Novick, Kim & Lee, PLLC; Allen Xue

(57) ABSTRACT

This disclosure provides a new type of shading device for windows. The shading device comprises two sheets of glass, a blind with a plurality of slates, and an actuating device rotating them. The slats are painted with a low reflectivity coating on one side and a high reflectivity coating on the other side. The blind is installed inside the air tight chamber formed by two sheets of glass. In addition, a low emissivity film can be applied on the wall of the air tight chamber. The shade device employs a control system to adjust the angle of the blind slats in response to various input signals.

10 Claims, 2 Drawing Sheets

(56) References Cited

U.S. PATENT DOCUMENTS

| | | | | | |
|---|---|---|---|---|---|
| 4,664,169 | A * | 5/1987 | Osaka et al. | 160/107 |
| 4,978,181 | A * | 12/1990 | Inanuma et al. | 359/360 |
| 5,000,242 | A * | 3/1991 | Coddens | 160/107 |
| 5,226,466 | A * | 7/1993 | Coddens | 160/107 |
| 5,282,504 | A * | 2/1994 | Anderson et al. | 160/107 |
| 5,379,824 | A * | 1/1995 | Carvalho | 160/90 |
| 5,396,944 | A * | 3/1995 | Rossini | 160/107 |
| 5,600,920 | A * | 2/1997 | Roy | 49/64 |
| 5,649,395 | A * | 7/1997 | Durham | 52/173.3 |
| 5,669,179 | A * | 9/1997 | Hanlon | 49/64 |
| 5,699,845 | A * | 12/1997 | Jelic | 160/107 |
| 5,826,638 | A * | 10/1998 | Jelic | 160/107 |
| 5,839,492 | A * | 11/1998 | Young | 160/107 |
| 6,123,137 | A * | 9/2000 | Levert | 160/107 |
| 6,230,442 | B1 * | 5/2001 | Kokar | 49/64 |
| 6,568,131 | B1 * | 5/2003 | Milano, Jr. | 49/82.1 |
| 6,601,633 | B2 * | 8/2003 | Sun et al. | 160/107 |
| 6,715,528 | B2 * | 4/2004 | Rossini | 160/107 |
| 6,817,401 | B2 * | 11/2004 | Sun et al. | 160/107 |
| 6,964,731 | B1 * | 11/2005 | Krisko et al. | 204/192.12 |
| 7,000,670 | B2 * | 2/2006 | Kwon et al. | 160/107 |
| 7,082,982 | B2 * | 8/2006 | Eveland et al. | 160/107 |
| 7,234,501 | B1 * | 6/2007 | Park et al. | 160/107 |
| 7,434,353 | B2 * | 10/2008 | Nien et al. | 49/82.1 |
| 7,669,633 | B2 * | 3/2010 | Berger | 160/107 |
| 7,896,056 | B2 * | 3/2011 | Ben-David | 160/107 |
| 8,245,444 | B2 * | 8/2012 | Konstantin et al. | 49/82.1 |
| 8,302,938 | B2 * | 11/2012 | Ebeling | 256/59 |
| 8,365,468 | B2 * | 2/2013 | Weekes | 49/92.1 |
| 8,462,437 | B2 * | 6/2013 | Thuot et al. | 359/596 |
| 8,499,815 | B2 * | 8/2013 | Zhang | 160/176.1 R |
| 2003/0075285 | A1 * | 4/2003 | Anderson et al. | 160/90 |
| 2003/0173036 | A1 * | 9/2003 | Kwon et al. | 160/107 |
| 2006/0288645 | A1 * | 12/2006 | Konstantino et al. | 49/92.1 |
| 2008/0000157 | A1 * | 1/2008 | Nien et al. | 49/82.1 |
| 2008/0244979 | A1 * | 10/2008 | Huang et al. | 49/82.1 |
| 2011/0010994 | A1 * | 1/2011 | Wilson et al. | 49/61 |
| 2011/0209408 | A1 * | 9/2011 | Scharf et al. | 49/31 |
| 2013/0086843 | A1 * | 4/2013 | Baek | 49/82.1 |
| 2013/0291438 | A1 * | 11/2013 | Selzer | 49/82.1 |

FOREIGN PATENT DOCUMENTS

| | | | |
|---|---|---|---|
| CN | 200996245 | Y | 12/2007 |
| CN | 101285368 | A | 10/2008 |
| CN | 101358505 | A | 2/2009 |
| CN | 201196008 | Y | 2/2009 |
| CN | 201196009 | Y | 2/2009 |
| CN | 101519947 | A | 9/2009 |
| CN | 201560697 | U | 8/2010 |

* cited by examiner

SHADING DEVICES

RELATED APPLICATIONS

This application claims the benefit of priority under 35 U.S.C. §119 to U.S. Provisional Applications Nos. 61/447,050 and 61/447,051, both filed on Feb. 27, 2011, the entire contents of which are incorporated herein by reference.

TECHNICAL FIELD

The present disclosure relates to shading device for windows and window panels having such shading devices and methods for controlling such shading devices.

RELATED ART

Buildings are exposed to different kinds of weather conditions. It is usually hot in summer and cold in winter. However, people always hope to keep indoor environment cool in summer and warm in winter. This would consume a large amount of energy using air-conditioning systems or heating systems. As a result, energy-saving buildings are very desirable and its shading system plays a very important role.

Most of the existing shading devices can be categorized into three types: exterior shading system, interior shading system, and double skin curtain wall shading system. They all have advantages and disadvantages.

The exterior shading system is excellent in keeping almost all the solar radiation out. The disadvantages include dust buildup, poor reliability, difficulties in maintenance, bad facade appearance, ineffective use of solar radiation in winter and so on.

The interior shading system overcomes some disadvantages of exterior shading system but its shading effectiveness is poor. Because the blind is heated by solar radiation and then the heat diffuses indoor. In addition, the interior shading system also has disadvantages such as prone to damage and dust buildup.

The double skin curtain wall shading system has the same advantages of exterior system and is more reliable. However, dust can still build up in between the two curtain walls, and all solar heat are wasted in winter.

Another problem caused by traditional shading system in winter is that it is impossible to shade and retain the solar heat at the same time. Shading is required because of glare control, but all the heat is lost with traditional shading systems.

One additional problem caused by traditional shading system in-between-glasses in summer is that it is impossible to shade and reject the solar heat trapped in-between-glasses at the same time. Shading is required because of glare control or cooling load reduction, but all the heat is trapped between the glasses and half of them will be transferred to interior space.

These are some of the problems the shading device of this disclosure intend to solve.

SUMMARY

This disclosure provides a shading device for a building. One embodiment of the shading device comprises a pair of glass sheets, a blind having a plurality of slats, and an actuating device that rotates the slats. One glass sheet—the interior glass sheet—is adjacent to the interior of the building while the other glass sheet—the exterior glass sheet—is adjacent to the exterior of the building. An air tight chamber can be formed between the glass sheets with the blind installed inside the chamber. The blind slats can be painted with a low reflectivity coating on one side and a high reflectivity coating the other side. In addition, a low emissivity film is applied on the surface of exterior glass sheet that faces the air tight chamber, i.e., the inner surface. The air tight chamber can be filled with inert gas in order to reduce the overall conductivity of this device.

In another embodiment of the shading device, a low emissivity film is applied on the surface of the interior glass sheet that faces the air tight chamber, i.e., the inner surface.

The actuating device is connected to a central processing unit so that this shading device can track the sun automatically. The central processing unit calculates a solar elevation angle according to the signals comprising the date and time, and the longitude and altitude of the actual location of this device. The central processing unit then sends a signal to the actuating device to rotate the blind slats to a pre-set angle, i.e., perpendicular to solar beams. The solar elevation angle calculated based on date and time, and the longitude and altitude of the actual location of the device is more accurate and reliable than that calculated based on signals generated by light sensors.

The central processing unit can also be connected to temperature sensors and/or light sensors in the signal input side. Based on the ambient temperature and ambient lighting, it controls the actuating device to rotate to a pre-set angle. This device may have a multiplicity of operating modes, for example, summer sunny day, summer cloudy day, summer night, winter sunny day, winter cloudy day, winter night. The blind slats are set to rotate to different pre-set angles in each mode so that the amount of heat transferred indoor can be controlled.

In order to meet various requirements of indoor temperature and a manual switch can also be connected to the signal input side of central processing unit. When the manual switch is being adjusted, the central processing unit changes the blind slats' rotating angle according to the signals sent by the manual switch. Although the default rotating angles are able to meet the requirements of temperature and lighting in most circumstances, manual switch is installed to provide additional control.

When the shading device is in a heat-retaining mode, the blind slats' low reflectivity coating is adjusted toward the sun so that the sunlight is refracted indoor to increase indoor temperature. Meanwhile, the low emissivity film coated on the inner surface of the exterior glass sheet prevents the long wave radiation from the blind and indoor objects from escaping to the exterior.

When the shading device is in a heat-rejecting mode, the blind slats' high reflectivity coating is adjusted toward the sun so that the sunlight is blocked and reflected. Meanwhile, the low emissivity film coated on the inner surface of the interior glass sheet prevents the long wave radiation from the blind from entering the interior of the building.

BRIEF DESCRIPTION OF THE DRAWINGS

The teachings of the present invention can be readily understood by considering the following detailed description in conjunction with the accompanying drawings.

Figure 1:
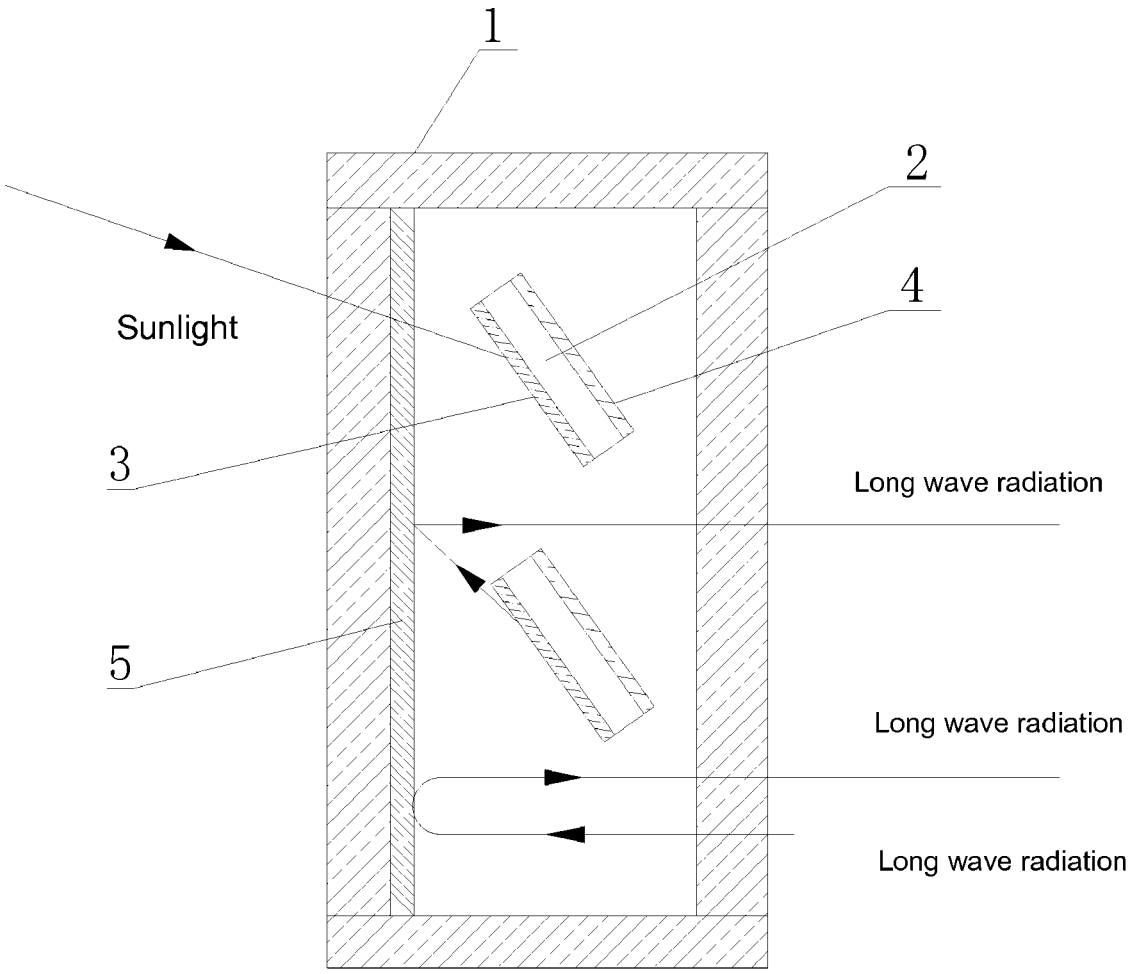
FIG. 1 is a sectional view of glass window pane of heat-retaining shading device.

Graphic representation: 1. glass; 2. blind; 3. low reflectivity coating; 4 high reflectivity coating; 5. low emissivity film;

6 actuating device; 7. central processing unit; 8. temperature sensor; 9. light sensor; 10. manual switch.

DETAILED DESCRIPTION

Reference will now be made in detail to embodiments of the present disclosure, examples of which are illustrated in the accompanying drawings. It is noted that wherever practicable, similar or like reference numbers may be used in the drawings and may indicate similar or like elements.

The drawings depict embodiments of the present disclosure for purposes of illustration only. One skilled in the art would readily recognize from the following description that alternative embodiments exist without departing from the general principles of the present disclosure.

Figure 2:
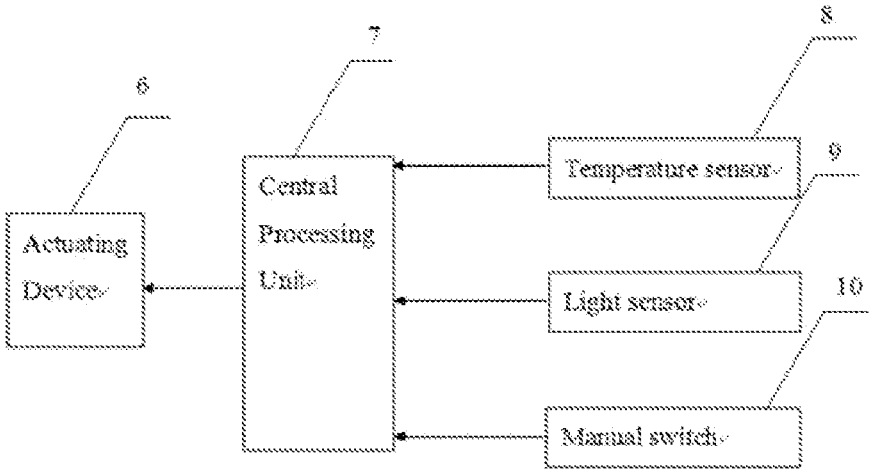
FIG. 2 is electrical structural schematic diagram of an embodiment of the shading device.
Figure 3:
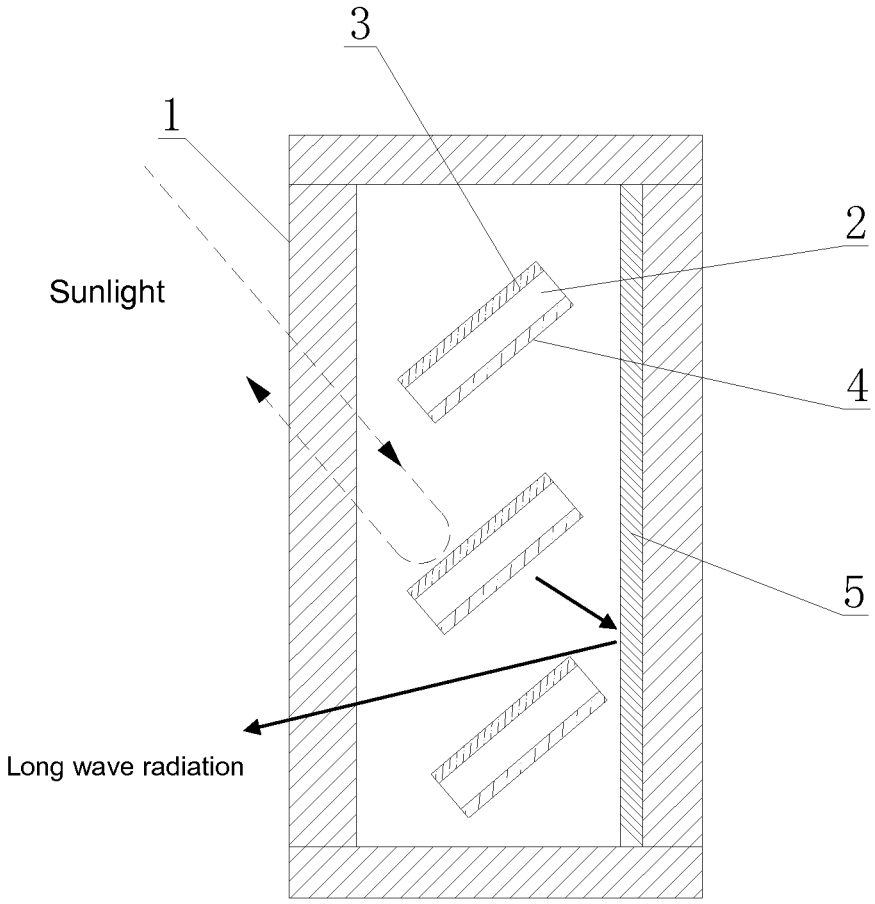
FIG. 3 is a sectional view of glass window pane of heat-rejecting shading device.

FIGS. 1,2, 3 illustrate several embodiments of the current disclosure. According to FIG. 1, one embodiment comprises an air tight chamber formed by two sheets of glasses 1, a blind having a plurality of slats 2, and an actuating device 6 used to drive the blind 2. The chamber is air tight and the blind 2 is installed inside the chamber. The glass 1 can be made of tempered glass and the blind 2 can be made of aluminum alloy. The front and back side of blind slats are painted with a low reflectivity coating 3 and a high reflectivity coating 4 respectively. A low emissivity film 5 covers the inner surface of the exterior glass sheet. In the device depicted in FIG. 1, it is estimated that 95% of the sunlight can be absorbed by low reflectivity coating 3. The long wave radiation produced by the blind and indoor materials is reflected indoor by low emissivity film 5 to reduce heat loss and improve insulating performance. This embodiment is referred to as the heat-retaining shading device.

Compared with the embodiment depicted in FIG. 1, the embodiment of FIG. 3 has the low emissivity film 5 applied on the inner surface of the interior glass sheet. Consequently, the long wave radiation produced by the heated blind is blocked by low emissivity film 5 from being transferred to the indoor space. This embodiment is referred to as the heat-rejecting shading device. In both embodiments of FIGS. 1 and 2, the air tight chamber can be filled with inert gas to decrease conductivity.

FIG. 2 is a schematic diagram of a control system that can be a part of the shading devices disclosed herein, comprising: a central processing chip 7, a temperature sensor 8, a light sensor 9, and a manual switch 10. The central processing unit 7 is connected to the controlling side of actuating device 6. Temperature sensor 8, light sensor 9 and manual switch 10 are all connected to the signal input side of central processing unit 7.

Using date, time, and longitude and altitude of the location, the central processing unit 7 calculates the solar elevation angle and then controls the actuating device to drive blind slats to rotate a pre-set angle, i.e., perpendicular to the solar beam. In addition, the central processing unit 7 also controls the actuating device 6 to rotate the blind slats depending on the signals sent by temperature sensor and light sensor. The manual switch is linked to the central processing unit 7 in its signal input side. The signals sent by manual switch control the central processing unit 7 to adjust the blind slats' rotating angle to users' desired position.

The following is an equation used to calculate the solar elevation angle:

$$\sin hs = \sin\delta \sin\phi + \cos\delta \cos\phi \cos\omega$$

in which hs: solar elevation angle (blind slat's angle in summer=solar elevation angle, blind slats' angle in winter=180−solar elevation angle)

δ: solar declination

{(90±23.5)−altitude−y*0.25 (y refers to days apart from the Summer Solstice and Winter Solstice)}

ϕ: local altitude

ω refers to solar hour angle which is 0° at local high noon; negative in forenoon, −15° per hour; positive in afternoon, +15° per hour. It changes 15° hourly on the equatorial plane.

Shading devices in this disclosure can be operated in either manual mode or automatic mode. When operating in the manual mode, the user adjusts manual switch and sends signals to the central processing unit 7. While in the automatic mode, the height and angle of blind slats are both calculated by the central processing unit.

Various automatic operating modes can be categorized based on the temperature and lighting signals collected by temperature sensor 8 and light sensor 9. Automatic operating mode can be further divided into the following categories: summer sunny day, summer cloudy day, summer night, winter sunny day, winter cloudy day, and winter night.

For example, if the temperature is higher than 20° C., this device is in summer mode. Otherwise, it is in the winter mode. The day time can be either sunny or cloudy. It is sunny when the illuminance is no less than, for example, 500 lux. Otherwise, it is a cloudy day. When the illuminance is no more than, for example, 100 lux, it is considered night time.

During sunny days in both summer and winter, the blind slats rotate to track solar angle (i.e., high reflectivity coating is turned toward the sun so that it is perpendicular to the solar beam).

In summer, the blind slats rotate to shield sunlight by keeping the intersection angle between high reflectivity coating and horizontal plane to, for example, less than 90°.

In winter, the blind slats rotate to keep the intersection angle between high reflectivity coating and horizontal plane between, for example, 90° and 180°. Furthermore, the low reflectivity coating is turned toward the sun to reflect sunlight indoor.

FIG. 1 is the schematic diagram of this embodiment when working in winter in the northern areas. The aluminum alloy blind track the sunlight incident angle in response to the sensors installed outdoor. The low reflectivity film is turned toward the sun to refract sunlight indoor so as to increase indoor temperature and decrease heating load.

In the northern cold weather dominated area, heat preservation is important because of its cold winters. Heat-retaining shading devices can be used to create shading while trapping solar heat. The low emissivity film is able to prevent a large portion of long wave radiation from escaping, keeping heat diffused by the blind and indoor objects inside to improve insulating performance.

In the southern hot weather dominated area, heat rejection is important because of its hot summers. Heat-rejecting shading devices can be used to create shading while blocking heat transfer from the air tight chamber to the interior of the building. The low emissivity film is able to prevent a large portion of long wave radiation from entering interior space, keeping heat diffused by the blind and indoor objects inside to improve insulating performance.

The following example uses heat-retaining shading devices in Beijing, China for illustration purposes. The heating season in Beijing is approximately from November 15 and March 15. The gross heat lost through windows of all orientations per unit area is shown below (in kWh/m$^2$):

| Type | Orientation | | | | |
|---|---|---|---|---|---|
| | East | west | South | north | ceiling |
| Common single-pane 5 mm glass | 98 | 100 | 94 | 106 | 167 |
| Double-pane glass | 66 | 65 | 63 | 69 | 105 |
| This device | 53 | 51 | 44 | 60 | 61 |

Comparing the heat loss through this device and other two traditional shading devices, it is estimated that the inventive shading device may reduce heat as in the following (in kWh/$m^2$):

| Type | East | west | South | north | ceiling |
|---|---|---|---|---|---|
| common single-pane glass | 45 | 49 | 50 | 46 | 106 |
| Double-pane glass | 13 | 14 | 19 | 9 | 44 |

Comparing the reduction in heat loss by using this inventive shading device and the heat lost by using other two devices, we can get the relative energy-saving rate:

| Type | east | west | south | north | ceiling |
|---|---|---|---|---|---|
| Common single-pane glass | 46% | 49% | 53% | 43% | 63% |
| Double-pane glass | 20% | 22% | 30% | 13% | 42% |

The following example uses heat-rejecting shading devices in Shanghai, China for illustration purposes. The cooling season of Shanghai is approximately from May 15 and October 15. The gross heat gain through windows of all orientations per unit area is shown below (in kWh/$m^2$):

| Type | Orientation | | | | |
|---|---|---|---|---|---|
| | East | west | South | north | ceiling |
| Common single-pane 5 mm glass | 236 | 232 | 185 | 119 | 493 |
| Double-pane glass | 212 | 207 | 162 | 111 | 428 |
| This device | 64 | 59 | 47 | 39 | 100 |

Comparing the heat loss through this device and other two normal shading devices, it is estimated that the inventive shading device may reduce heat as in the following (in kWh/$m^2$):

| Type | East | west | South | north | ceiling |
|---|---|---|---|---|---|
| common single-pane glass | 172 | 173 | 138 | 80 | 393 |
| Double-pane glass | 148 | 148 | 115 | 72 | 328 |

Comparing the reduction in heat gain by using this inventive shading device and the heat lost by using other two devices, the relative energy-saving rates are:

| Type | east | west | South | north | ceiling |
|---|---|---|---|---|---|
| Common single-pane glass | 73% | 75% | 75% | 67% | 80% |
| Double-pane glass | 70% | 71% | 71% | 65% | 77% |

According to real-time testing and calculating analyses, the main thermotechnical parameters are given in the following table:

| Technical index | Common double-pane glass | Low-E double-pane glass | This device |
|---|---|---|---|
| K 1 (coefficient of heat transfer) $W/m^2 \cdot k$ | 2.67 | 1.80 | 1.33~1.50 |
| SHGC2(Solar Heat Gain Coefficient)(summer) | 0.71 | 0.54 | 0.10~0.20 |
| SHGC2(Solar Heat Gain Coefficient)(winter) | 0.71 | 0.54 | 0.90~1.00 |

Note:

1. K represents to the insulating performance of window. Lower is better.
2. SHGC refers to the window's capability to gain solar heat (0-1). Higher is better in winter and lower is better in summer.

This invention solves several long-existing problems of traditional shading systems. With application of low reflectivity coating, the winter SHGC of this invention could be 80% higher than that of conventional blind and 38% higher than that of common low reflectivity filming double-pane glass. On the other hand, the blind will shut off automatically in winter night to prevent heat radiating to the outside. Moreover, when the blind is shut, the total heat transfer coefficient is equal to that of a triple-pane glasses, which could be as low as 1.33 kw/m2. Using south-facade installation of this invention as an example, in winter of Beijing, its energy consumption could 53% lower than that of single-pane glass and 30% lower than that of double-pane glass. As a result, this invention is more suitable for shading in south facade.

In summer, the high reflectivity coating of the blind is turned toward the sun, the blind slats rotate to shield sunlight and reject heat by keeping the intersection angle between high reflectivity coating and horizontal plane within 90°.

Embodiments of the present disclosure have been described in detail. Other embodiments will become apparent to those skilled in the art from consideration and practice of the present disclosure. Accordingly, it is intended that the specification and the drawings be considered as exemplary and explanatory only, with the true scope of the present disclosure being set forth in the following claims.

What is claimed is:

1. A shading device for a building, comprising:

a chamber formed between a sheet of glass adjacent to the interior of the building and a sheet of glass adjacent to the exterior of the building;

a blind having a plurality of slats installed inside the chamber;

an actuating device, wherein the actuator rotates the plurality of slats, wherein each of the plurality of slats has two opposite sides, and at least one of the slats has one side having a low reflectivity coating and the other side having a high reflectivity coating, wherein one of the two sheets of glass has a low emissivity film on a surface facing the chamber, wherein the actuator is controlled by a central processing unit, the central processing unit is configured to calculate a solar elevation angle and is configured to control the actuating device to rotate the plurality of slats to an angle, wherein the solar elevation angle is calculated to according to the following equation:

$$\sin hs = \sin \delta \cdot \sin \phi + \cos \delta \cdot \cos \phi \cdot \cos \omega$$

wherein hs represents the solar elevation angle,

δ represents a solar declination, which equals {(90±23.5)−altitude−y*0.25} wherein y refers to a number of days apart from the Summer Solstice or the Winter Solstice ϕ represents a local altitude, ω refers to solar hour angle which is 0° at a local high noon, negative in forenoon at −15° per hour away from the local high noon, and positive in afternoon and +15° per hour away from the local high noon.

2. The shading device of claim 1, wherein the angle of the slats is determined so that one surface of the slat is perpendicular to an incident solar beam.

3. The shading device of claim 2, wherein the surface of the slat having the high reflectivity coating is perpendicular to the incident solar beam.

4. The shading device of claim 1, wherein the central processing unit receives a temperature signal from a temperature sensor, a lighting signal from a light sensor, or both.

5. The shading device of claim 4, wherein the central processing unit determine an operation mode of the shading device based on the temperature signal, the lighting signal, or both.

6. The shading device of claim 1, wherein the central processing unit receives a signal from a manual switch so as to manually control actuating device to rotate the plurality of slats to the predetermined angle.

7. The shading device of claim 1, wherein the low emissivity film is on the surface of the glass adjacent to the interior of the building.

8. The shading device of claim 1, wherein the low emissivity film is on the surface of the glass adjacent to the exterior of the building.

9. A method for controlling a shading device, comprising:

providing a shading device, wherein the shading device comprises:

a chamber formed between a sheet of glass adjacent to the interior of the building and a sheet of glass adjacent to the exterior of the building;

a blind having a plurality of slats installed inside the chamber;

an actuating device, wherein the actuator rotates the plurality of slats, wherein each of the plurality of slats has two opposite sides, and at least one of the slats has one side having a low reflectivity coating and the other side having a high reflectivity coating, wherein one of the two sheets of glass has a low emissivity film on a surface facing the chamber;

calculating the solar elevation angle according to an equation as follows:

$$\sin hs = \sin \delta \cdot \sin \phi + \cos \delta \cdot \cos \phi \cdot \cos \omega$$

wherein hs represents the solar elevation angle,

δ represents a solar declination, which equals {(90±23.5)−altitude−y*0.25}, wherein y refers to a number of days apart from the Summer Solstice or the Winter Solstice, ϕ represents a local altitude, ω refers to solar hour angle which is 0° at a local high noon, negative in forenoon at −15° per hour away from the local high noon, and positive in afternoon and +15° per hour away from the local high noon; and controlling the actuating device to rotate one or more of the plurality of slats to a predetermined angle.

10. The method of claim 9, wherein the predetermined angle of the slat equals the solar elevation angle in summer and equals (180°−the solar elevation angle) in winter.

* * * * *